US010888728B2

(12) United States Patent
Carriere

(10) Patent No.: US 10,888,728 B2
(45) Date of Patent: Jan. 12, 2021

(54) KINETIC RESISTANCE APPARATUS

(71) Applicant: AORTE FITNESS INC., Kingston (CA)

(72) Inventor: Robert Omer Carriere, Kingston (CA)

( * ) Notice: Subject to any disclaimer, the term of this patent is extended or adjusted under 35 U.S.C. 154(b) by 0 days.

(21) Appl. No.: 16/276,280

(22) Filed: Feb. 14, 2019

(65) Prior Publication Data

US 2019/0175975 A1 Jun. 13, 2019

Related U.S. Application Data

(63) Continuation-in-part of application No. 15/085,749, filed on Mar. 30, 2016, now Pat. No. 10,207,140.

(Continued)

(51) Int. Cl.
*A63B 23/12* (2006.01)
*A63B 21/04* (2006.01)

(Continued)

(52) U.S. Cl.
CPC ..... *A63B 21/0442* (2013.01); *A61H 1/0222* (2013.01); *A61H 1/0237* (2013.01); *A61H 1/0274* (2013.01); *A61H 1/0281* (2013.01); *A63B 21/00069* (2013.01); *A63B 21/0087* (2013.01); *A63B 21/00178* (2013.01); *A63B 21/00181* (2013.01); *A63B 21/023* (2013.01); *A63B 21/0552* (2013.01); *A63B 21/154* (2013.01); *A63B 21/1609* (2015.10); *A63B 21/4005* (2015.10); *A63B 21/4009* (2015.10); *A63B 21/4025* (2015.10); *A63B 21/4035* (2015.10); *A63B 21/4043* (2015.10); *A63B 23/0355* (2013.01); *A63B 23/03541* (2013.01); *A63B 23/04* (2013.01); *A63B 23/1209* (2013.01); *A61H 2201/1261* (2013.01); *A61H 2201/1418* (2013.01); *A61H 2201/1436* (2013.01); *A61H 2201/165* (2013.01); *A61H 2201/1642* (2013.01);

(Continued)

(58) Field of Classification Search
CPC ..... A63B 21/1609; A63B 21/4025; A63B 21/0442; A63B 21/151; A63B 21/156; A63B 2208/0233; A47C 9/002; Y10S 482/904

See application file for complete search history.

(56) References Cited

U.S. PATENT DOCUMENTS 3,162,441 A * 12/1964 Karlik ..... A63B 21/00061 482/124
3,162,442 A * 12/1964 Karlik ..... A63B 21/0442 482/124

(Continued)

*Primary Examiner* — Joshua T Kennedy

(57) ABSTRACT

A portable and kinetic motion resistance upper body invention that can be used for a variety of exercises. This invention combines dial tension adjustment clutch sheaves, a variable linear tract bearing and a one piece resistance shock-cord, together these core components achieve a unique minimal impact work-out. The multi-motion and changeable adjustments for this invention, result in a wide variety of muscular stimulation and therapeutic exercises that are non-existent in the fitness and health industry. The outcome of the mechanism can be customized for a particular sport requirement or physio and other therapeutic restorations, or even for case specific industrial and robotic counter-balancing controls. This invention is can also be used as a lift-assist device.

19 Claims, 11 Drawing Sheets

Related U.S. Application Data

(60) Provisional application No. 62/144,526, filed on Apr. 8, 2015.

(51) Int. Cl.

| | |
|---|---|
| ***A63B 21/00*** | (2006.01) |
| ***A63B 21/02*** | (2006.01) |
| ***A63B 21/055*** | (2006.01) |
| ***A63B 23/035*** | (2006.01) |
| ***A63B 23/04*** | (2006.01) |
| ***A61H 1/02*** | (2006.01) |
| ***A63B 21/16*** | (2006.01) |
| ***A63B 21/008*** | (2006.01) |
| *A63B 71/00* | (2006.01) |

(52) U.S. Cl.

CPC ..... *A63B 2071/0018* (2013.01); *A63B 2208/0204* (2013.01); *A63B 2208/0233* (2013.01)

(56) References Cited

U.S. PATENT DOCUMENTS

| | | | | | |
|---|---|---|---|---|---|
| 4,961,573 | A * | 10/1990 | Wehrell | A63B 21/0552 | 482/124 |
| 5,792,034 | A | 8/1998 | Kozlovsky | | |
| 5,813,953 | A | 9/1998 | Whipple | | |
| 6,159,113 | A | 12/2000 | Barber | | |
| 6,159,133 | A * | 12/2000 | Shugg | A63B 21/023 | 482/121 |
| 6,280,365 | B1 * | 8/2001 | Weber | A63B 21/018 | 482/124 |
| 7,563,212 | B2 * | 7/2009 | Smith | A63B 21/025 | 482/124 |
| 7,775,936 | B2 | 8/2010 | Wilkinson | | |
| 8,162,809 | B1 | 4/2012 | Eastwood | | |
| 8,727,952 | B1 * | 5/2014 | Carle | A63B 21/4043 | 482/102 |
| 9,409,501 | B2 * | 8/2016 | Henry | A63B 21/00069 | |
| 9,649,522 | B2 | 5/2017 | Wyatt et al. | | |
| 9,795,818 | B2 | 10/2017 | Powell | | |
| 10,576,325 | B2 * | 3/2020 | Tedesco | A63B 21/4007 | |
| 2005/0221965 | A1 * | 10/2005 | Boland | A63B 21/0004 | 482/121 |
| 2006/0217245 | A1 | 9/2006 | Golesh et al. | | |
| 2010/0041526 | A1 * | 2/2010 | Bowser | A63B 21/04 | 482/123 |
| 2011/0183819 | A1 * | 7/2011 | Pharoe | A63B 21/0552 | 482/105 |
| 2012/0058864 | A1 | 3/2012 | Mizrachy | | |
| 2012/0065039 | A1 * | 3/2012 | Alessandri | A63B 21/04 | 482/142 |

* cited by examiner

KINETIC RESISTANCE APPARATUS

CROSS-REFERENCE TO RELATED APPLICATIONS

This application is a continuation-in-part of U.S. Pat. No. 10,207,140, titled "KINETIC RESISTANCE APPARATUS" filed on Mar. 30, 2016.

BACKGROUND

The inventor recognized a need for an upper body exercise apparatus that is lightweight, portable, versatile, low impact, multi-muscle targeting, and totally adjustable. The unit ideally should be able to vary in tension to accommodate the exercise needs of physiotherapy patients with decreased mobility, to the strongest and most mobile athletes. This invention has created a solution that supports portability, while providing kinetic alignment. The user of this invention can simultaneously exercise the lower and upper body, while performing natural movements, such as, but not limiting to walking, jogging, running, and skating.

SUMMARY

In some embodiments, the Kinetic Resistance Apparatus relates to apparatuses disclosed in U.S. application Ser. No. 15/085,749 and can involve multiple central or control sheaves anchored within and on a linear track bearing and coupled to a spring set.

The Kinetic Resistance Apparatus is an exercise device that allows the user to apply additional mass output with individual or dually extended arm movements. The device solves for natural kinetic outputs, using mechanically aligned configurations. In the worn on back position, the user can mimic natural bodily movements, allowing for a greater mass output and shorter training intervals. This device uses a fluid form of singular impact transfer, allowing for anti-climactic retraction. This retraction targets the opposite arms negative muscle tissues, to correct form and balance while performing various upper body movements.

The Kinetic Resistance Apparatus is a lift assist device. For example, when worn on the back, the apparatus supports arm movements or allows for shifting force form the dominant to the dependent arm. As such, force applied by a dominant arm is redirected or shifted to the dependent arm, thereby assisting the dependent arm. The apparatus is used as a lift assist, for example, for firearms, defence objects, tools, cargo, or boxes.

DETAILED DESCRIPTION

Figure 1:
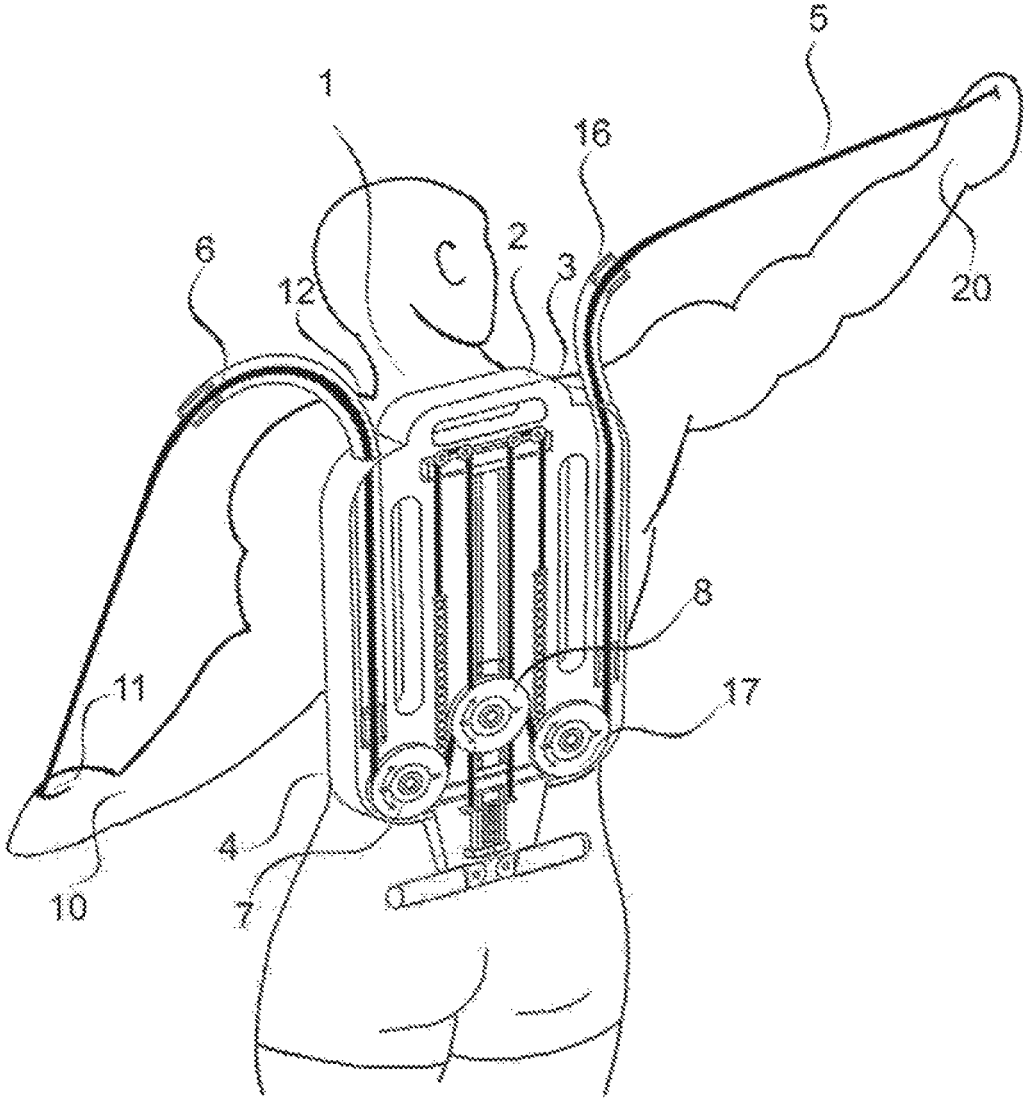
FIG. 1 is a rear view of a person wearing the kinetic resistance apparatus on his back, extending his right arm forward and his left arm downward.
Figure 2:
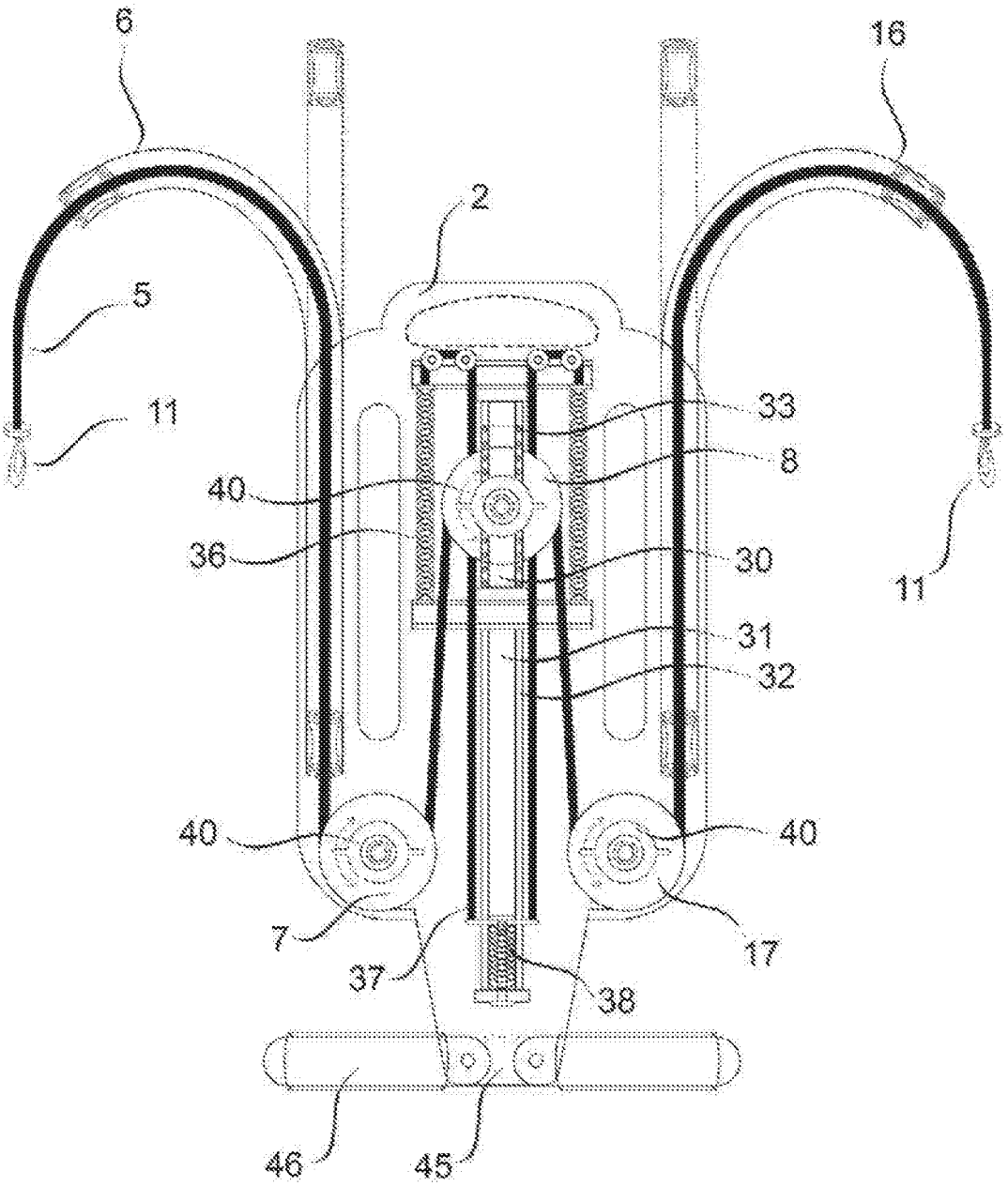
FIG. 2 is a view of the inner workings of the kinetic resistance apparatus, in the non-extended position. This position places the operating sheave at the minimal tension position.
Figure 3:
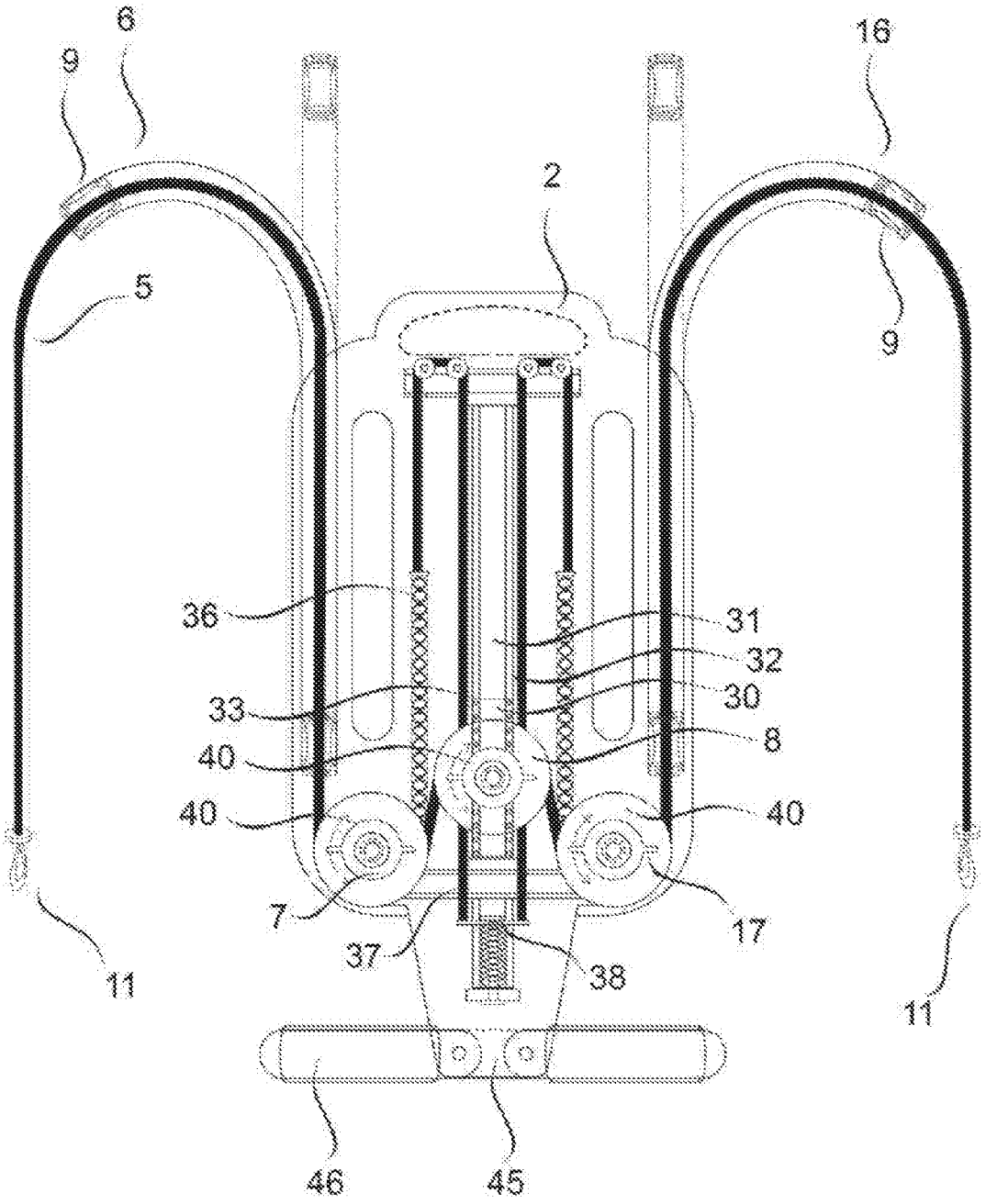
FIG. 3 is a view of the inner workings of the kinetic resistance apparatus, in the extended position. This position places the operating sheave at the maximum tension position.
Figure 4:
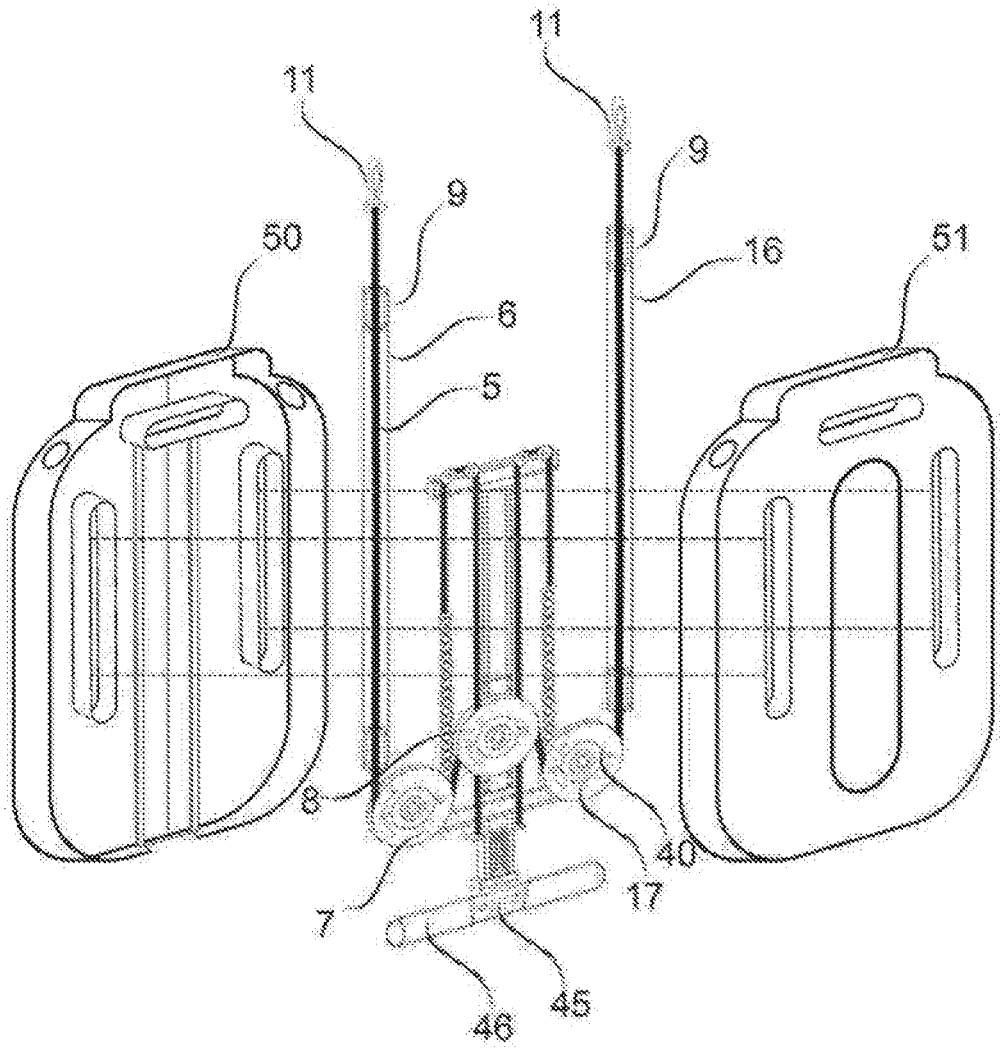
FIG. 4 is a sectional breakdown of the kinetic resistance apparatus, and its operating features.
Figure 5:
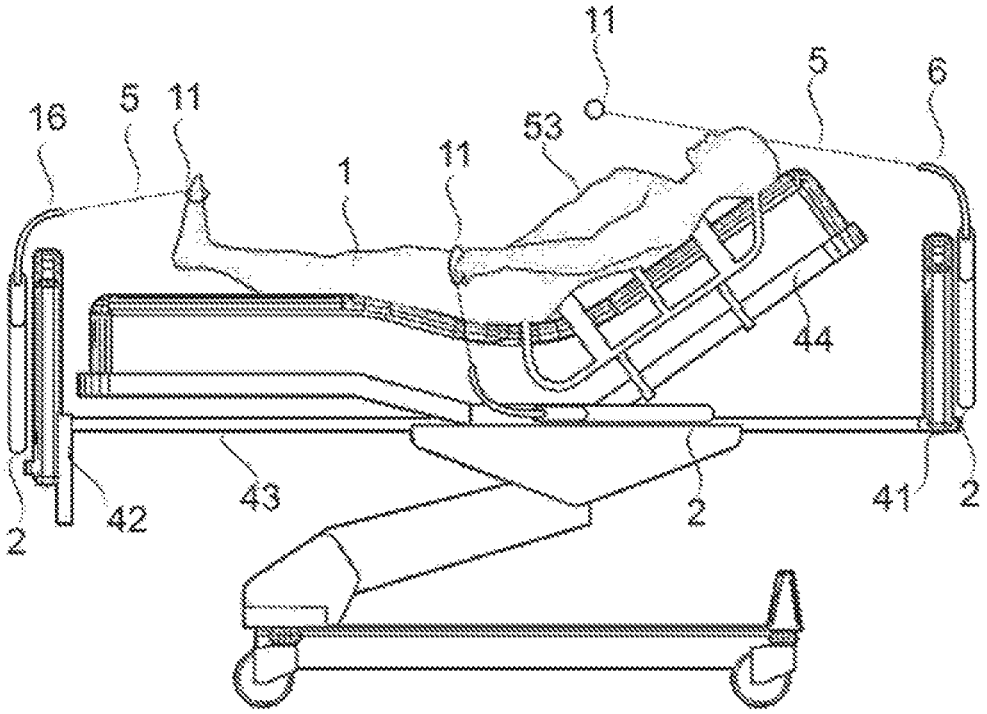
FIG. 5 is a view of an optional application, by which the kinetic resistance apparatus is attached to a hospital bed in multiple configurations and/or positions. These positions function to perform therapeutic requirements of various muscle groups.
Figure 6:
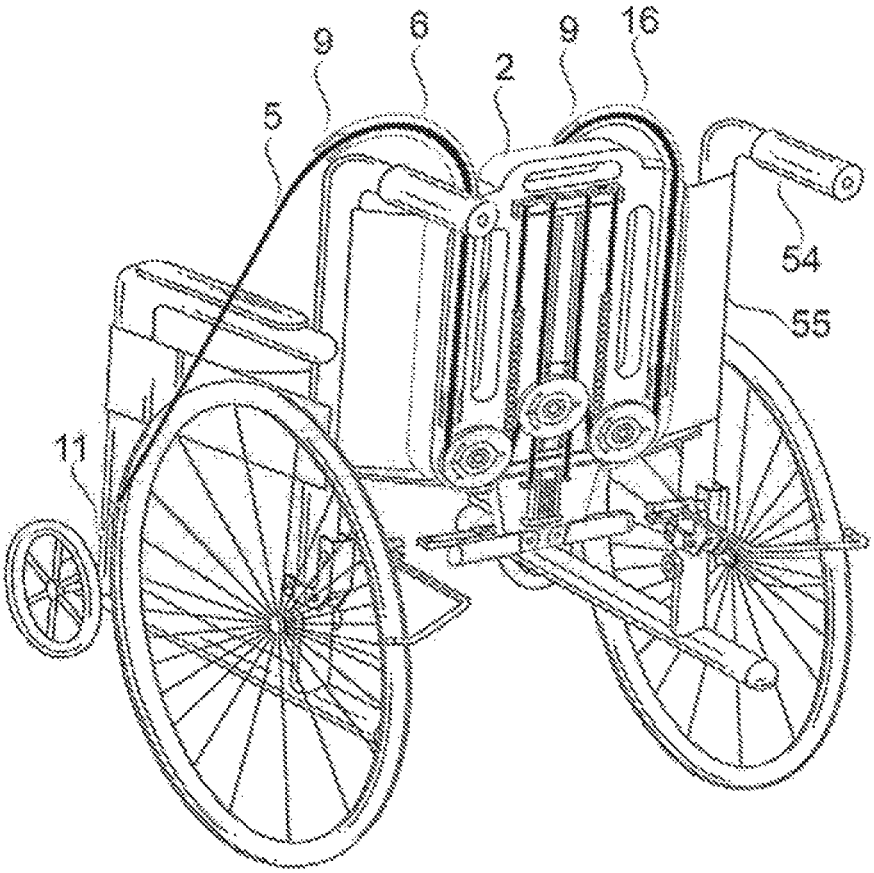
FIG. 6 is an isometric view of the kinetic resistance apparatus attached to a wheelchair or other applicable device.

FIG. 1.

A fitness apparatus (2) mounted to the back of an individual (1). It is anchored to the individual (1) via shoulder straps (3), waist straps (4) and/or a wearable fabric vestment. This apparatus is primarily for upper body physiotherapy and exercise.

The operation of the apparatus (2); begins with the left hand and arm (10) of the individual (1) in a downward stretching exercise. A ring or handle (11) works as a holding device for an elastic or stretchable cord (5). The elastic or stretchable cord (5) is protruding from and guided by a flexible tube (6) that is curving over the shoulder (12). The left flexible tube (6) guides the stretchable cord (5) into the fitness apparatus (2) and into the left re-directional sheaves (7). There are two re-directional sheaves, one for the left side (7) and one for the right side (17). The stretchable cord (5) circles around the re-directional sheaves (7) and forwards the stretchable cord (5) to the central sheave (8). The central sheave (8) forwards the stretchable cord (5) to the opposing/right re-directional sheave (17). The stretchable cord (5) circles around the right re-directional sheave (17) and into the opposing/right flexible tube (16). This flexible tube (16) guides the stretchable cord (5) within it and over the right shoulder (15). The stretchable cord (5) exits the right flexible tube (16) and forwards towards the right hand (20). This individual (1) is shown with the right hand and arm (20) being stretched and exercised in an outward fashion. The exercise and movements can be in all angles of forward, upward, downward and outward directions.

In some embodiments, the flexible tubes are made from materials including, but not limited to, plastic, fabric, or metals.

FIG. 2

This is a detailed image of the inner workings of the apparatus (2). This drawing demonstrates the path of the stretchable cord (5) and its path inside the flexible tubes (6) and (16). The path of the stretchable cord (5) is also shown circling around the left (7) and right (17) re-directional sheaves. It also shows the one piece stretchable cord (5) going around the central sheave (8). This design of a one piece/one length of stretchable cord (5) results in a uniform tension across the complete stroke.

To further enhance the uniformity of tension in the stroke, the central sheave (8) is anchored within and on a linear track bearing (30). This linear track bearing comprises of, but not limited to a sliding rail (31) and an anchored rail (32) with roller bearing (33). The roller bearing (33) provides a quiet and smooth travel up and down the anchored rail (32). The travel of the linear bearing (30) movement is further tensioned by restricting the travel using coiled tension springs (36). These coiled tension spring (36) expand and contract with the motion of the linear track bearing (30). The linear track bearing (30) tension is further made adjustable by attaching the coiled tension springs (36) via a cable (37) to a tension adjustment (38). This unique feature varies the tension through different parts of the stroke.

This diagram also displays the dial clutch adjustable tensioner (40) located on both the left (7) and right (17) re-directional sheaves as well as on the central sheave (8). Adjusting these dial clutch adjustable tensioners on the left (7) and right (17) re-directional sheaves results in an increase or decrease tension for either the left arm (10) or right arm (20) as required. The dial clutch adjustable tensioner (40) on the central sheave (8) adjust the overall tension for the complete stroke.

FIG. 3.

This drawing shows the tensioners (36) for the linear bearing (30) in different stages of adjustment. The coiled tension springs (36) are in the expansion state and the positioning of the coiled tension spring (36) anchor has been lowered by adjusting the tension adjustment (38). This results in changing the higher tension of the stroke from the beginning of the stroke to the end of stroke.

This drawing also visually shows the stretchable cord (5) extended outward and at the end of the stroke beyond the flexible tube (7) and (17) ends. Both ends of the flexible tube (7) and (17) are shown to have tapered insert (9). These tapered inserts (9) allow the stretchable cord (5) to travel smoothly in and out of the flexible tubing (6) without damage, or friction.

At the base (45) of the apparatus (2) is a contoured padded support (46). This padded support (46) rests firmly and comfortably on the lower back and above the buttocks of the individual (1). This padded support (46) also doubles as a foot anchor for a multitude of additional exercises.

FIG. 4.

This is an isometric view of the apparatus (2) and displays how the apparatus (2) is constructed of a formed backing case (50) and a formed frontal case (51). The formed backing case (50) and the formed frontal case (51) are interlocked together to create a sealed enclosure (52). Within the lightweight sealed enclosure (52) are the re-directional sheaves (7) and (17), the flexible tubes (6) and (16), the central sheave (8) as well as all the working components in the adjustable linear track bearing assembly (30).

FIG. 5.

This is a two dimensional drawing applying the apparatus (2) in the fixed position at the headboard (41), footboard (42), and base (43) of a hospital bed (44). In these positions the apparatus (2) can take advantage of the adjustable tensioners (40), to achieve the ideal physio requirements for a bed (44) ridden patient (53). The apparatus (2) in these positions headboard (41), footboard (42) and base (43), are strategically positioned to maximize the most common physiotherapy needs of the patient (53). It is considered by this inventor that the apparatus (2) can be fixed but not limited to these positions or this particular type of structure (e.g. it can also be fixed to a wall).

FIG. 6.

This is a three-dimensional view of the apparatus (2) attached to a mobile device, in this example a wheelchair (54). The apparatus (2) is anchored to the back of this mobile device, however, it can be attached to the seat (55) or other location to achieve the physiotherapy needs of the patient. The apparatus (2) may also work as an assistance for an automated exercise for incapacitated legs to prevent muscle atrophy. It is considered by this inventor that the apparatus (2) can be fixed to multiple mobile devices (e.g. airplane seats, vehicle passenger seats, etc.).

Figure 7:
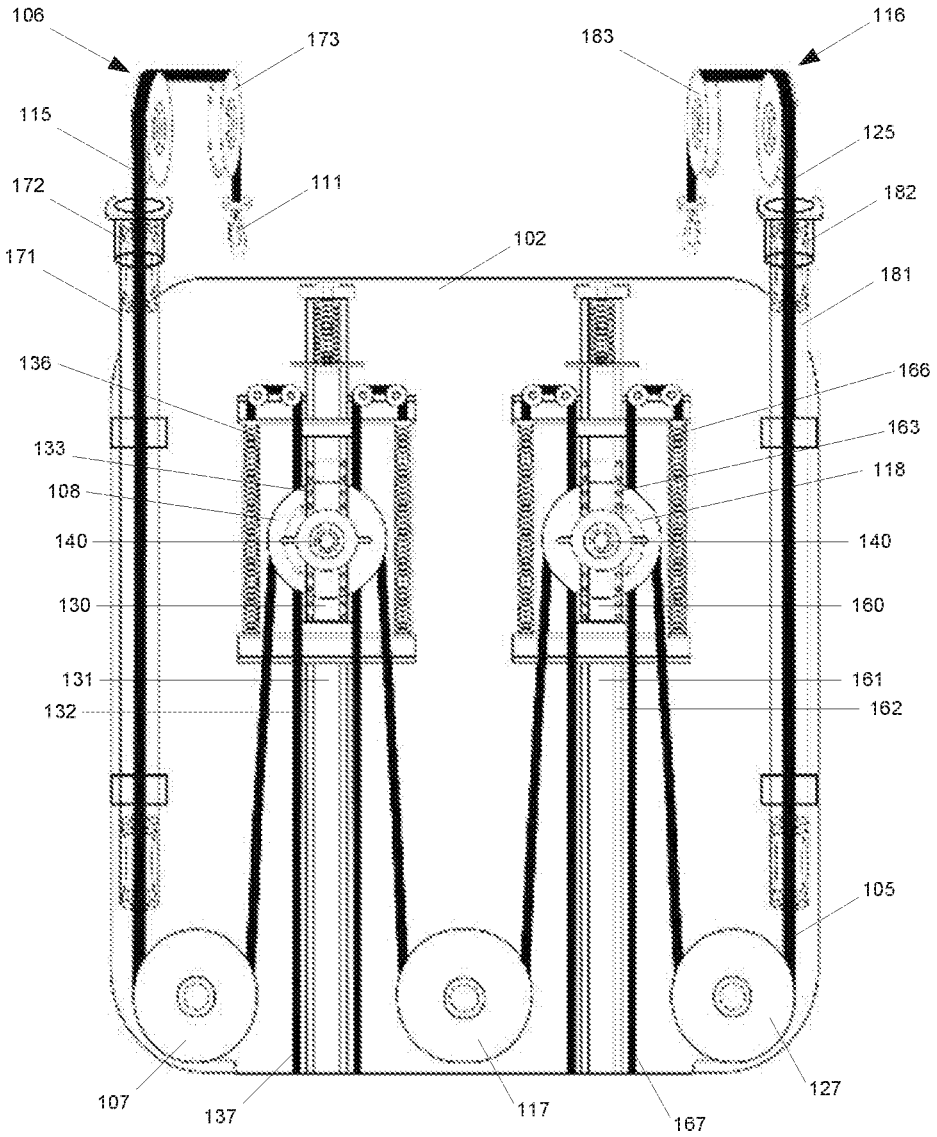
FIG. 7 is a view of the inner workings of another embodiment of the kinetic resistance apparatus in a non-extended position. The kinetic resistance apparatus has two central sheaves and left and right hinged shoulder attachments.
Figure 8:
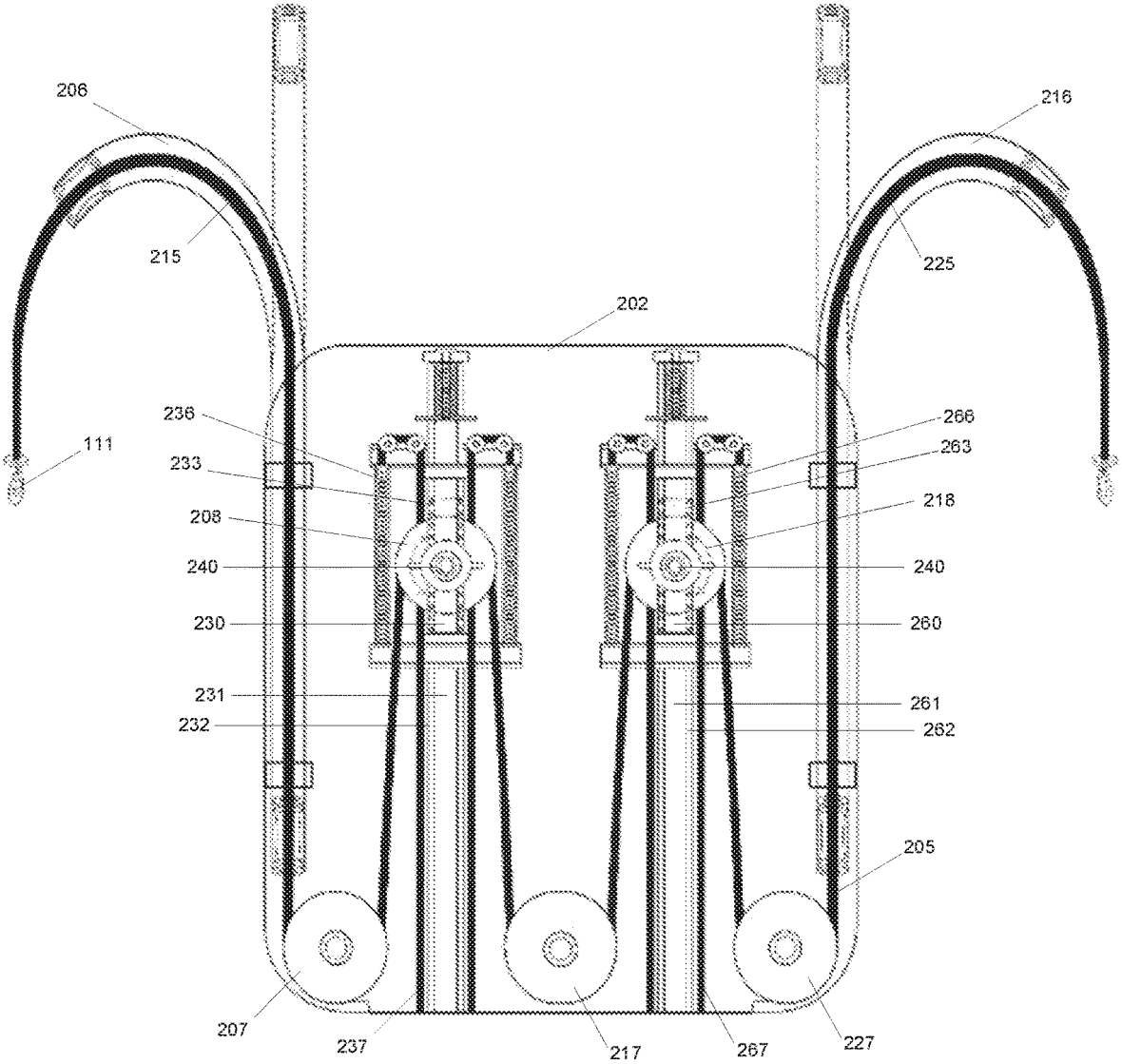
FIG. 8 is a view of the inner workings of another embodiment of the kinetic resistance apparatus in a non-extended position. The kinetic resistance apparatus has two central sheaves and left and right flexible tubes.
Figure 9:
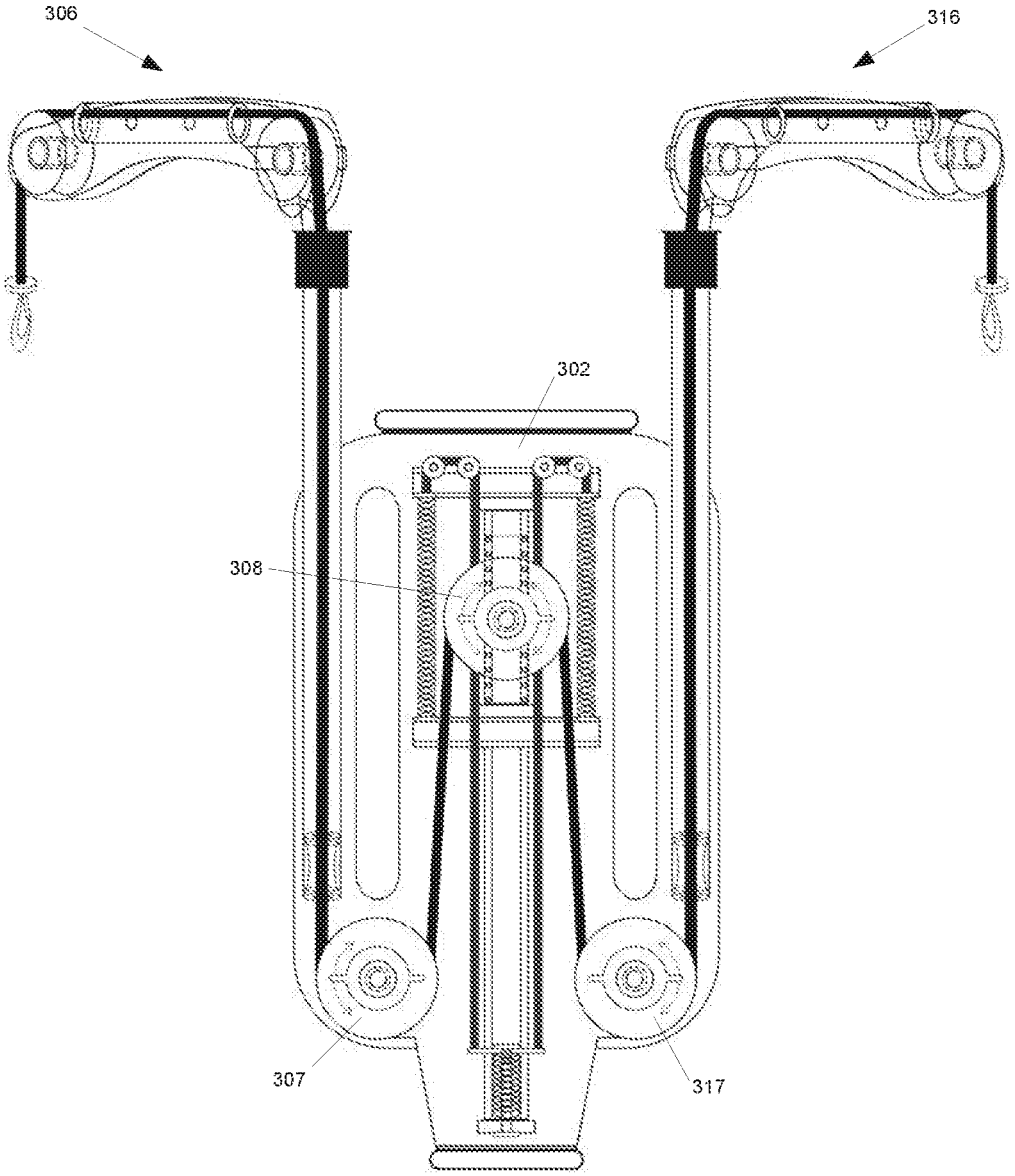
FIG. 9 is a view of the inner workings of another embodiment of the kinetic resistance apparatus in a non-extended position. The kinetic resistance apparatus has one central sheave and left and right hinged shoulder attachments.
Figure 10:
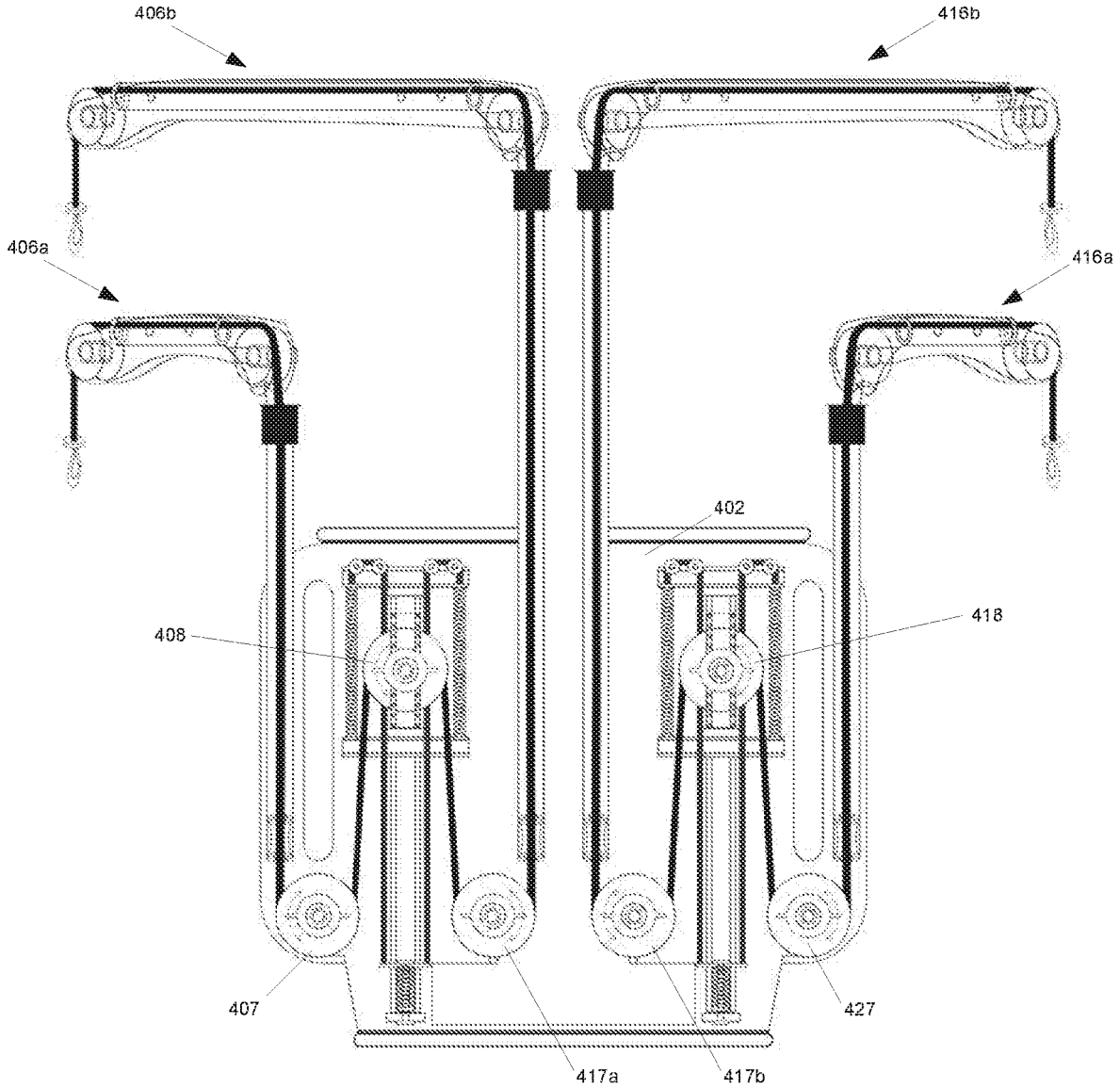
FIG. 10 is a view of the inner workings of another embodiment of the kinetic resistance apparatus in a non-extended position. The kinetic resistance apparatus has two cords, two central sheaves and two pairs of left and right hinged shoulder attachments.
Figure 11:
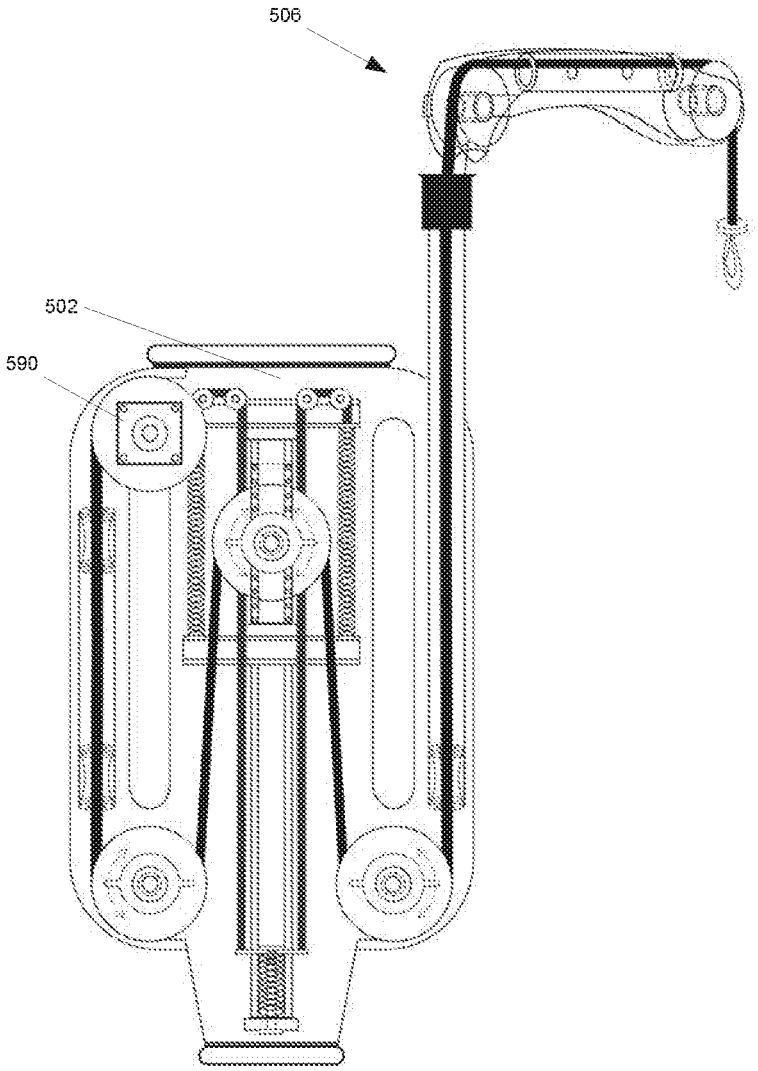
FIG. 11 is a view of the inner workings of another embodiment of the kinetic resistance apparatus in a non-extended position. The kinetic resistance apparatus has one central sheave and one hinged shoulder attachment.

FIGS. 7 and 8 show an apparatus having two central sheaves each anchored within and on a linear track bearing, and left and right re-directional sheaves. By introducing two central sheaves, the apparatus allows for a longer length of cord and selective control of tension in the left and right ends of the stretchable cord. A longer stretchable cord is advantageous for a greater range. Since the cord circles around the two central sheaves, the degree to which left and right central sheaves travel up and down their respective linear track varies depending on the pulling force applied to the two ends of the cord. For example, where a greater pulling force is applied on the right end of the cord than the left end, the range of travel by the right central sheave along its linear track is greater than the left central sheave.

In an embodiment, differences in the pulling force is attributed to difference in strength of the dominant and dependent arms. In some cases, differences in the pulling force is attributed to difference in resistance, such as a greater load attached to one end relative to another end of the cord. For example, In some embodiments, sensors (such as displacement sensors) are coupled to the central sheaves and/or the linear tracks to detect the degree of travel. Information obtained from such sensors is useful, for example, for monitoring strength of the dominant and dependent arms. In some embodiments, the kinetic resistance apparatuses have sensor and/or transmission modules, for example, displacement sensors, gyroscopes, accelerometer, conductive-line/wire, tensiometer, or combinations thereof. For example, the sensor module detects the tension in the cord or the coiled tension springs, and outputs a numerical indicator on a display device. In one embodiment, the apparatus has a blue-tooth sensor/wireless transmission module for receiving tension setting commands for controlling the adjustable tensioner and for transmitting signals representing apparatus status for display on a screen.

In some embodiments, the left and right central sheaves have tensioners that are independently or dependently adjustable to provide different levels of tensions on the left and right ends of the cord. In some embodiments, the left and right re-directional sheaves have tensioners that are independently or dependently adjustable to provide different levels of tensions on the left and right ends of the cord. In some embodiments, all the sheaves (including, but not limited to central and re-directional sheaves) have tensioners that are independently or dependently adjustable to provide different levels of tensions on the left and right ends of the cord. In some embodiments, the at least one of the sheaves have tensioners that are adjustable. Examples of tensioners include, but are not limited to, a dial clutch adjustable tensioner or anchors. In preferred embodiments, the tension on the left and right ends of the cord are adjusted as needed to control shifting of force from one end to another. Control of force shift from one end of the cord to another end is advantageous when using the apparatus as a lift assist advice. If a first end of the cord is attached to a load, applying force on a second end of the cord translates to displacement of the load on the first end. For example, if the right end of the cord is couple to a user's right arm which is carrying a firearm, the tensioner of the right central and/or re-directional sheave is separately adjusted for tremor control.

FIG. 7.

This is a detailed image of the inner workings of the apparatus (102), having a right and a left module. This drawing demonstrates the path of a one piece stretchable cord (105) from the left end (115) to the right end (125). In some embodiments, the apparatus has left and right hollow guide-rods (171, 181, respectively). The guide-rods may be solid or flexible. The guide-rods guide the left and right ends (115, 125) of the cord to a desired position. Guide-rods can be fixed-length rod or telescopic rod. Guide-rods may be anchored into a fixed position, or adjustable in position by use of adjustable guide-rod anchors.

In some embodiments, the guide-rod is coupled to a rotational bearing (172, 182) and one or more secondary distributive sheave(s) (173) of the shoulder attachments. The rotational bearings are located on the exit end of the guide-rods. The secondary distributive sheave(s) is attached via coupling or hollow bracket to the rotational bearing mounts, allowing for rotational cord distribution, which is fixed or locked as desired.

As shown in FIG. 7, the apparatus has left and right hinged shoulder attachments (106, 116, respectively). In some embodiments, the shoulder is a jib frame. The shoulder attachments include a secondary set of distributive sheave(s) (173, 183). The left end (115) of the cord is guided or supported by the left hinged shoulder attachment (106), while the right end (125) is guided or supported by the right hinged shoulder attachment (116) for redirecting the cord in a desired direction. A ring or handle (111) works as a holding device for the stretchable cord (105).

From the left end (115), the path of the stretchable cord (105) is shown circling around the left re-directional sheave (107), around the left central sheave (108), and then around the middle re-directional sheave (117). It also shows the stretchable cord (105) then going around the right central sheave (118), around the right re-directional sheave (127), and then to the right end (125). This design of a one piece/one length of stretchable cord (105) results in a uniform tension across the complete cord. The apparatus (102) also allows for a uniform first tension across the left end (115) to provide a first applied force, and a uniform second tension across the right end (125) to provide a second applied force. The apparatus (102) allows for the same or different uniform tension across the left and right ends. In some embodiments, the applied force is an upward force to provide lift-assist. The shoulder attachments (106, 116) allows for the applied force to be applied in a desired direction.

The left module includes the left central sheave (108) anchored within and on a left linear track bearing (130) to further enhance the uniformity of tension in the left end (115) of the cord (105). This left linear track bearing is comprised of, but not limited to a left sliding rail (131) and a left anchored rail (132) with left roller bearing (133). The left roller bearing (133) provides a quiet and smooth travel up and down the left anchored rail (132). The travel of the left linear bearing (130) movement is further tensioned by restricting the travel using left coiled tension springs (136). These coiled tension spring (136) expand and contract with the motion of the left linear track bearing (130).

The right module includes the right central sheave (118) anchored within and on a right linear track bearing (160) to further enhance the uniformity of tension in the right end (125) of the cord (105). This right linear track bearing is comprised of, but not limited to a right sliding rail (161) and a right anchored rail (162) with right roller bearing (163). The right roller bearing (163) provides a quiet and smooth travel up and down the right anchored rail (162). The travel of the right linear bearing (160) movement is further tensioned by restricting the travel using right coiled tension springs (166). These coiled tension spring (166) expand and contract with the motion of the right linear track bearing (160).

The linear track bearing (130, 160) tension is further made adjustable by attaching the coiled tension springs (136, 166) via a cable (137, 167) to a tension adjustment (not shown).

This diagram also displays the dial clutch adjustable tensioner (140) located on both the left (108) and right (118) central sheaves. Adjusting these dial clutch adjustable tensioners on the left (108) and right (118) central sheaves results in an increase or decrease in tension when pulling on either the left end (115) or right end (125), respectively, of the stretchable cord (105) as required. In embodiments where the left (107) and right (127) re-directional sheaves also have dial clutch adjustable tensioners, adjusting these dial clutch adjustable tensioners further increases or decrease the tension of the left end (115) or right end (125), respectively, as needed. Each of the dial clutch adjustable tensioners can be selectively adjusted to achieve a first tension in the left end, and a second tension in the right end. The dial clutch adjustable tensioner can also be adjusted together to adjust the overall tension where a uniform tension on both the left and right ends are desired.

FIG. 8.

This is a detailed image of the inner workings of the apparatus (202), having a right and a left module. This drawing demonstrates the path of a one piece stretchable cord (205) from the left end (215) to the right end (225). The cord (205) is protruding from and guided by flexible tubes (106, 116), such as tube, which curves over the shoulder of the user. The left flexible tube (206) guides the left end (215) into the apparatus (202) and into the left re-directional sheaves (207), while the right flexible tube (216) guides the right end (225) into the apparatus (202) and into the right re-directional sheaves (227). In some embodiments, the apparatus has left and right guide-rods that guide the left and right ends (215, 225) of the cord to a desired position, and optionally the flexible tubes are attached to the guide-rods via coupling or hollow bracket to rotational bearing mounts. The rotational bearing allows for rotational cord distribution, which can be fixed or locked.

From the left end (215), the path of the stretchable cord (205) is shown circling around the left re-directional sheave (207), around the left central sheave (208), and then around the middle re-directional sheave (217). It also shows the stretchable cord (205) then going around the right central sheave (218), around the right re-directional sheave (227), and then to the right end (225). This design of a one piece/one length of stretchable cord (205) results in a uniform tension across the complete stroke. The apparatus (202) also allows for a uniform first tension across the left stroke, and a uniform second tension across the right stroke. The apparatus (202) allows for the same or different uniform tension across the left and right strokes.

The left module includes the left central sheave (208) anchored within and on a left linear track bearing (230) to further enhance the uniformity of tension in the left stroke. This left linear track bearing is comprised of, but not limited to a left sliding rail (231) and a left anchored rail (232) with left roller bearing (233). The left roller bearing (233) provides a quiet and smooth travel up and down the left anchored rail (232). The travel of the left linear bearing (230) movement is further tensioned by restricting the travel using left coiled tension springs (236). These coiled tension spring (236) expand and contract with the motion of the left linear track bearing (230).

The right module includes the right central sheave (218) anchored within and on a right linear track bearing (260) to further enhance the uniformity of tension in the right stroke. This right linear track bearing is comprised of, but not limited to a right sliding rail (261) and a right anchored rail (262) with right roller bearing (263). The right roller bearing (263) provides a quiet and smooth travel up and down the right anchored rail (262). The travel of the right linear bearing (260) movement is further tensioned by restricting the travel using right coiled tension springs (266). These coiled tension spring (266) expand and contract with the motion of the right linear track bearing (260).

The linear track bearing (230, 260) tension is further made adjustable by attaching the coiled tension springs (236, 266) via a cable (237, 267) to a tension adjustment (not shown). This unique feature varies the tension through different parts of the stroke.

This diagram also displays the dial clutch adjustable tensioner (240) located on both the left (208) and right (218) central sheaves. Adjusting these dial clutch adjustable tensioners on the left (208) and right (218) central sheaves results in an increase or decrease in tension when pulling on either the left end (215) or right end (225), respectively, of the stretchable cord (205) as required. In embodiments where the left (207) and right (227) re-directional sheaves also have dial clutch adjustable tensioners, adjusting these dial clutch adjustable tensioners further increases or decrease the tension for the left and right stroke, respectively, as needed. Each of the dial clutch adjustable tensioner can be selectively adjusted to achieve a first tension for the left stroke, and a second tension for the right stroke. The dial clutch adjustable tensioner can also be adjusted together to adjust the overall tension where a uniform tension for both the left and right strokes are desired.

FIG. 9.

This is a detailed image of the inner workings of another embodiment of the apparatus (302), having one central sheave (308) and a left and right re-directional sheaves (307, 317). The apparatus also has left and right hinge shoulder attachments (306, 316), for use as a lift assist device.

The apparatuses shown in FIGS. 7 and 8 have two linear tract bearings in parallel. In some embodiments, the apparatus has multiple linear tract bearings in parallel and/or series. This configuration allows for extending the length of the stretchable cord, which in turn extends the reach of the device. Given the longer reach and the addition of crane assemblies, the apparatus provides multi-positional tracking and distribution of applied force. By stacking multiple linear tract bearings in parallel, the apparatus has multiple central sheaves which act as control sheaves for controlling tension in the cord. The apparatus can have various number of control sheaves and various combinations and positions of control sheaves based on use and/or need.

In some embodiments, the linear track bearing is coupled to an electric current generator. For example, in exercise mode, as the linear track bearing travels up and down the anchored rail, electric current is generated and the generated electricity is stored in a battery.

FIG. 10.

This is a detailed image of the inner workings of another embodiment of the apparatus (402), having two central sheaves (408, 418), each associated with a separate cord. The left cord circles around the left re-directional sheave (407), the left central sheave (408), and then around the left middle re-directional sheave (417*a*). The right cord circles around the right re-directional sheave (427), the right central sheave (418), and then around the right middle re-directional sheave (417*b*). The apparatus also has two pairs of hinge shoulder attachments for use as a lift assist device. The outer pair of hinged shoulder attachments (406*a*, 416*a*) receives the ends of the cords from the left and right re-directional sheaves. The inner pair of hinged shoulder attachments (406*b*, 416*b*) receives the ends of the cords from the left and right middle re-directional sheaves.

In some embodiments, the hinged shoulder attachments are oriented above the apparatus. In some embodiments, some of the hinged shoulder attachments are oriented above the apparatus, while others are oriented below the apparatus. In one embodiment, the apparatus has four hinged shoulder attachments positioned at four ends of the apparatus to align with the arms and legs of the user.

FIG. 11.

This is a detailed image of the inner workings of another embodiment of the apparatus (502) having a single hinged shoulder attachment. The right end of the cord is supported or guided by the hinged shoulder attachment (506), while the left end of the cord terminates at an anchor (590).

In some embodiments, the anchor include a motor, such as a servomotor, for automatic retraction of the cord. In some embodiments, a servo motor is positioned between the two ends of the cord. For example, a servomotor is placed on the linear bearings or the middle re-directional sheave. Having a motor for automatic retraction of the cord is advantageous for further limb-lift assist, or firearm or object lift assist.

In some embodiments, the middle re-directional sheave is an anchor for anchoring a middle or an end segment of the cord. In one embodiment, the middle re-directional sheave has a tensioner which at sufficiently high tension prevents the cord from moving, thereby converting the middle re-directional sheave into an anchor.

In some embodiments, the kinetic resistance apparatuses has tension spring sets coupled to the control sheaves. These spring sets maintain the required load distribution capability of the bearing tension vs the tension applied through the force exertion of the cord use. Given varying load distribution requirement for different use purposes, in some embodiments a kinetic resistance apparatus is equipped with a singular, dual, or a plurality of springs sets. In other embodiments, the apparatus has a piston, an actuator, or other adjustable resistance technology coupled to the control sheaves. For example, a control sheave is coupled to a shock cord, or pneumatic/hydraulic cylinder.

In some embodiments, the kinetic resistance apparatus has a control sheave (such as a central sheave) coupled with a dial clutch adjustable tensioner. In other embodiments, the kinetic resistance apparatus has a control sheave (such as a central sheave) coupled with anchors (such as nut/bolt or bracket). Controlling these control sheaves causes the spring sets to adjust resistance, to alternate the position of the control sheave, and/or actuate to a resistance setting via manual or electronic control.

The kinetic resistance apparatus allows for fluid distribution of a single length of cord from one end to the other (for fitness uses) or one opposing object to another (for other uses). In some embodiments, the apparatus has a single length of cord that is a resistance cord (for strength and actuation). In other embodiments, the apparatus has a single length of cord that is a zero-tension cord or a non-stretchable cord for use in lift-assist requirements. In yet other embodiments, the single length of cord is or includes, for example, a measurement cord, a wire, a conductive line, or other feasible single length cord.

In some embodiments, the kinetic resistance apparatus has both ends of the cord equipped with handles, clips, or other attachments devices. The attachment devices are removable or interchangeable. Example attachment devices include, but are not limited to, gloves, handles, rackets, sleeves, wraps, balls, etc. In some embodiments, the kinetic resistance apparatus has integrated handles, including attachments devices that grasp onto the cord using alternate distributive sheaves. In embodiments having integrated handle attachments, the handle pulls along the cord, or is actuated by a clutched, tension, or other propelling based system (manual or electronic).

The invention claimed is:

1. An apparatus configured to be mounted to the back of an individual or to a fixed structure, comprising:

a series of sheaves, wherein one or more of the sheaves are tensioned adjustably;

a single length of cord which tracks around the series of sheaves to provide an adjustable tension on the cord, the cord having free ends on each side of the apparatus;

wherein the series of sheaves are tension adjusted for shifting force from a first end of the cord to a second end of the cord; and wherein the series of sheaves comprise one or more movable central sheave and one or more linear track bearing, wherein each of the one or more movable central sheave is anchored to and movable along one of the one or more linear track bearing as a result of pulling of the cord.

2. The apparatus of claim 1, wherein the series of sheaves comprises fixed left and right re-directional sheaves.

3. The apparatus of claim 2, wherein each of the left and right re-directional sheaves has a tensioner to individually increase or decrease tension of the cord.

4. The apparatus of claim 1, wherein each of the one or more movable central sheave has a tensioner to individually increase or decrease tension of the cord.

5. The apparatus of claim 1, comprising a plurality of adjustable linear track bearings and a plurality of movable central sheave, each movable central sheave anchored to and movable along one of the plurality of adjustable linear track bearings.

6. The apparatus of claim 5, wherein the plurality of adjustable linear track bearings are arranged in parallel.

7. The apparatus of claim 1 wherein the linear track bearing comprises coiled tension springs that expand or contract with motion of the linear track bearing, wherein the linear track bearing provides the tension via the springs as the movable central sheave moves along the linear bearing as a result of pulling of the cord.

8. The apparatus of claim 1, comprising one or more flexible tubes on either side of the apparatus for guiding the cord into the fixed left and right re-directional sheaves, the free ends of the cord protruding from the flexible tubes.

9. The apparatus of claim 1, comprising one or more hinged support structures rotationally mounted on the apparatus for directing the free ends of the cord in a desired orientation.

10. The apparatus of claim 1, comprising an anchor for anchoring a segment of the cord.

11. The apparatus of claim 1, wherein the cord is stretchable.

12. A lift-assist apparatus configured to be mounted to the back of an individual or to a fixed structure for shifting force, the apparatus comprising:

fixed left and right re-directional sheaves;

one or more movable central sheave;

one or more linear track bearing, each having a resistance device;

wherein each of the one or more central sheave is anchored to and movable along one of the one or more linear track bearing;

a cord having free ends on each side of the apparatus; and one or more hinged shoulder attachment for directing the free ends of the cord in a desired orientation;

wherein the cord circles around the re-directional and the one or more central sheaves such that each of the one or more linear track bearing provides a tension via the resistance device as the central sheave moves along the linear bearing as a result of pulling of the cord;

wherein each of the resistance device is attached to a tension adjustment to vary the tension on the cord.

13. The apparatus of claim 12, comprising tensioners attached to each of the re-directional sheaves to individually increase or decrease tension of the cord.

14. The apparatus of claim 12, comprising tensioners attached to each of the one or more central sheave to individually increase or decrease tension of the cord.

15. The apparatus of claim 12, wherein each linear track bearing comprises a sliding rail, and an anchored rail with a roller bearing, and wherein the resistance device comprises one or more coiled tension springs, a shock cord, a piston, or an actuator.

16. The apparatus of claim 12, comprising two shoulder attachment rotationally mounted on the apparatus for directing a left and a right end of the cord.

17. The apparatus of claim 12, comprising a single shoulder attachment rotationally mounted on the apparatus for directing a first end of the cord.

18. The apparatus of claim 17, comprising an anchor attached to a second end of the cord.

19. The apparatus of claim 12, wherein the cord is not stretchable.

* * * * *